US009075382B2

(12) United States Patent
Nakamura et al.

(10) Patent No.: US 9,075,382 B2
(45) Date of Patent: Jul. 7, 2015

(54) IMAGE FORMING APPARATUS

(71) Applicant: Sharp Kabushiki Kaisha, Osaka (JP)

(72) Inventors: Hirokazu Nakamura, Osaka (JP); Tatsuya Shinkawa, Osaka (JP); Kousuke Namisaki, Osaka (JP); Motoki Ohta, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 14/301,711

(22) Filed: Jun. 11, 2014

(65) Prior Publication Data

US 2014/0369724 A1 Dec. 18, 2014

(30) Foreign Application Priority Data

Jun. 13, 2013 (JP) ..... 2013-124650
Mar. 19, 2014 (JP) ..... 2014-056379

(51) Int. Cl.
*G03G 15/20* (2006.01)
*G03G 21/00* (2006.01)

(52) U.S. Cl.
CPC ..... *G03G 21/00* (2013.01)

(58) Field of Classification Search
USPC ..... 399/38, 44, 67, 68, 98, 99, 123, 320, 399/327–329
See application file for complete search history.

(56) References Cited

U.S. PATENT DOCUMENTS

2007/0280723 A1* 12/2007 Kurosu ..... 399/99
2008/0075486 A1* 3/2008 Takahashi et al. ..... 399/43

FOREIGN PATENT DOCUMENTS

JP 2009-169106 A 7/2009

* cited by examiner

*Primary Examiner* — Hoan Tran
(74) *Attorney, Agent, or Firm* — Renner, Otto, Boisselle & Sklar, LLP

(57) ABSTRACT

An image forming apparatus includes a pre-fusing paper sheet guide, a fuser unit and a control section. The pre-fusing paper sheet guide is disposed adjacent to the fuser unit on its upstream side. The fuser unit includes a pressing roller having, an electrically conductive surface, a grounding structure grounding a pressing roller's surface, and a cleaning mechanism cleaning the pressing roller's surface. The cleaning mechanism includes a web and a take-up roller. The control section sets a winding quantity x of the web to 0.7 mm when a setting for printing without margin is not made, and sets the winding quantity x to 2.1 mm when the setting for printing without margin is made. If the number of sheets accumulated through the image forming process becomes not less than 18, the control section causes the take-up roller to wind the web by the winding quantity x, and performs an image forming process.

10 Claims, 7 Drawing Sheets

IMAGE FORMING APPARATUS

CROSS REFERENCE

This Nonprovisional application claims priority under 35 U.S.C. §119(a) on Patent Application No. 2013-124650 filed in Japan on Jun. 13, 2013, and Patent. Application NO. 2014-056379 filed in Japan on Mar. 19, 2014, the entire contents of which are hereby incorporated by reference.

BACKGROUND OF THE INVENTION

The present invention relates to an image forming apparatus having a function of printing without margin that forms an image by transferring a toner image onto an imaging area and a margin of a paper sheet.

Among image forming apparatus are there ones having a function of printing without margin that forms an image onto an imaging area and a margin of a paper sheet, as well as ones forming an image onto an imaging area of a paper sheet leaving a margin blank.

An image forming apparatus according to the electrophotography method forms an image onto a paper sheet through an imaging process in which a toner image is formed on a surface of an image bearing member, a transfer process in which the toner image is transferred from the surface of the image bearing member onto the paper sheet, and a fixing process in which the toner image transferred is fixed on the paper sheet by heating and pressing. Among methods for realizing the function of printing without margin in such an image forming apparatus is there one method that forms a toner image wider than a width of the paper sheet in the imaging process and transfers the image onto the margin of the paper sheet in the transfer process (for example, refer to Japanese Patent Unexamined Publication No. 2009-169106 bulletin). However, because the toner image is formed wider than the width of the paper sheet in the imaging process, the toner that has not been transferred onto the paper sheet is scattered within the interior of the image forming apparatus and thus sticks to the paper sheet, thereby causing stains on the paper sheet. So that it is necessary to collect the scattered toner after the transfer process.

Therefore, it is conceivable to collect the scattered toner after the transfer process by providing an adsorption member that is given an electric potential difference in relation to the toner, thereby causing the toner scattered onto the surface of the adsorption member to stick to the surface thereof, and then to remove the toner from the surface of the adsorption member. Now, among methods for removing the toner from the surface of the adsorption member is there a web cleaning that removes the toner from the surface of the adsorption member by causing a belt-shaped cleaning member to be brought into contact with the surface of the adsorption member and then winding the cleaning member.

However, the amount of the toner sticking to the surface of the adsorption member varies depending on whether the function of printing without margin is used or not.

Therefore, in the case where the function of printing without margin is not used, carrying out the web cleaning in such a manner as to meet a need for the case where the function of printing without margin is used results in winding the cleaning member that is not dirty, which means wasting the cleaning member. Contrariwise, in the case where the function of printing without margin is used, carrying out the web cleaning in such a manner as to meet a need for the case where the function of printing without margin is not used means nothing other than trying to remove the toner on the surface of the adsorption member using a dirty cleaning member, and thus it is impossible to collect the scattered toner.

The present invention is directed to providing an image forming apparatus according to the electrophotography method that makes it possible, in web cleaning, to pertinently use a cleaning member depending on whether a function of printing without margin is used or not, and to surely collect a toner causing stains on a paper sheet.

SUMMARY OF THE INVENTION

An image forming apparatus of the present invention includes a paper sheet guide, an adsorption member, a cleaning means, an operating section and a control section. The paper sheet guide is a member on which a paper sheet a toner image has been transferred onto is conveyed. The adsorption member, being disposed in the neighborhood of the paper sheet guide, adsorbs toner scattered from the paper sheet conveyed on the paper sheet guide. The cleaning means includes a belt-shaped cleaning member that is in contact with a surface of the adsorption member and thereby cleans the surface of the adsorption member, and a drive section that winds the cleaning member. The operating section accepts a setting for printing without margin by which an image is formed with the toner image being transferred onto the paper sheet as far as at least one edge portion thereof. In a case where the operating section accepts the setting for printing without margin, the control section controls the drive section in such a manner as to increase a winding quantity of the cleaning member per unit time, as compared with a case where the operating section does not accept the setting for printing without margin.

When the paper sheet onto which the toner image is transferred as far as at least one edge portion thereof is conveyed on the paper sheet guide, the toner is scattered from the paper sheet. In order to collect the toner scattered from the paper sheet, the adsorption member that adsorbs the toner scattered from the paper sheet is disposed in the neighborhood of the paper sheet guide. The toner adsorbed by the adsorption member is removed by the belt-shaped cleaning member that is in contact with the surface of the adsorption member and is wound by the cleaning means. In this manner, the image forming apparatus collects the toner scattered from the paper sheet. Further, when the operating section accepts the setting for printing without margin, since more toner is scattered from the paper sheet than when the operating section does not accept the setting for printing without margin, the amount of the toner sticking to the surface of the adsorption member increases. In the case where the operating section accepts the setting for printing without margin, the control section controls the drive section in such a manner as to increase a winding quantity of the cleaning member per unit time, as compared with the case where the operating section does not accept the setting for printing without margin. In the case where the setting for printing without margin is made, the control section causes the cleaning member to be wound before the cleaning member becomes dirty due to the toner sticking thereto and thus unable to remove the toner from the surface of the adsorption member. Then, in the case where the setting for printing without margin is not made, the control section causes the cleaning member that is not dirty not to be wound because the cleaning member can remove the toner from the surface of the adsorption member.

Also, in a configuration where the adsorption member has, on the surface thereof, an electric conductivity, it is preferable that the adsorption member further includes an electric potential difference forming means that forms an electric potential difference between an electric potential of the surface of the adsorption member and an electric potential of the toner.

The electric potential difference forming means causes the toner scattered from the paper sheet to stick to the surface of the adsorption member by forming an electric potential difference between the toner and the surface of the adsorption member. This ensures that the toner scattered from the paper sheet is adsorbed by the adsorption member. As a result, it is made possible for the image forming apparatus to remove the toner from the surface of the adsorption member by the cleaning means, and thereby to surely collect the scattered toner.

Further, in a configuration where a fuser unit fixing the toner image on the paper sheet is disposed downstream from the paper sheet guide, it is preferable that the fuser unit includes a fixing rotational member, a heat source heating the fixing rotational member, and a pressing rotational member that is caused to be in contact with the fixing rotational member with pressure, and that either the fixing rotational member or the pressing rotational member also serves as the adsorption member.

The fuser unit is disposed downstream form the paper sheet guide. With such a configuration employed in the fuser unit that includes the fixing rotational member that is heated and the pressing rotational member that is in contact with the fixing rotational member with pressure, either the fixing rotational member or the pressing rotational member can also serve as the adsorption member. This makes it possible to realize a main component of a toner collector using the fuser unit that is essential to an image forming process. Thereby apparatus cost increase and apparatus upsizing can be suppressed as compared with a case where an adsorption member is provided separately.

Further, in a configuration where the cleaning member includes at least either a first cleaning member that is in contact with the surface of the fixing rotational member and thereby cleans the surface of the fixing rotational member or a second cleaning member that is in contact with the surface of the pressing rotational member and thereby cleans the surface of the pressing rotational member, it is preferable that the control section controls the drive section in such a manner as to increase a winding quantity of at least either the first cleaning member or the second cleaning member per unit time in the case where the operating section accepts the setting for printing without margin, as compared with the case where the operating section does not accept the setting for printing without margin.

In the case where the operating section accepts the setting for printing without margin, the control section causes one cleaning member that is in contact with one surface which is more likely to adsorb the scattered toner than the other surface between the surface of the fixing rotational member and the surface of the pressing rotational member to be wound in such a manner as to be given a more winding quantity per unit time, as compared with the case where the operating section does not accept the setting for printing without margin. This enables each of the first cleaning member and the second cleaning member to be wound before each of the first cleaning member and the second cleaning member becomes unable to remove the toner from each of the surfaces of the fixing rotational member and the pressing rotational member.

An image forming apparatus of the present invention includes a fuser unit, a cleaning means, an operating section and a control m section. The fuser unit includes a fixing rotational member, a heat source heating the fixing rotational member, and a pressing rotational member that is caused to be in contact with the fixing rotational member with pressure, and fixes the toner image on the paper sheet. The cleaning means includes a belt-shaped cleaning member that is in contact with a surface of the pressing rotational member and thereby cleans the surface of the pressing rotational member, and a drive section that winds the cleaning member. The operating section accepts a setting for printing without margin by which an image is formed with the toner image being transferred onto the paper sheet as far as at least one edge portion thereof in a width direction perpendicular to a conveyance direction. In a case where the operating section accepts the setting for printing without margin, the control section controls the drive section in such a manner as to increase a winding quantity of the cleaning member per unit time, as compared with a case where the operating section does not accept the setting for printing without margin.

In this configuration, when the operating section accepts the setting for printing without margin, because the toner image is transferred onto the paper sheet as far as at least the one edge portion thereof in the width direction perpendicular to the conveyance direction, the toner is more likely to be scattered from the paper sheet than when the setting for printing without margin is not accepted. The scattered toner sometimes sticks to the pressing rotational member of the fuser unit. In the case where the operating section accepts the setting for printing without margin, the control section causes the winding quantity of the cleaning member per unit time that is in contact with the surface of the pressing rotational member and thereby cleans the surface of the pressing rotational member to be increased as compared with the case where the operating section does not accept the setting for printing without margin. This enables, in the case where the setting for printing without margin is made, the cleaning member to be wound before the cleaning member becomes unable to remove the toner from the surface of the pressing rotational member. Then, in the case where the setting for printing without margin is not made, the control section causes the cleaning member that is not dirty not to be wound because the cleaning member can remove the toner from the surface of the pressing rotational member.

An image forming apparatus of the present invention includes a fuser unit, a cleaning means, an operating section and a control section. The fuser unit includes a fixing rotational member, a heat source heating the fixing rotational member, and a pressing rotational member that is caused to be in contact with the fixing rotational member with pressure, and fixes the toner image on the paper sheet. The cleaning means includes a belt-shaped cleaning member that is in contact with a surface of the fixing rotational member and thereby cleans the surface of the fixing rotational member, and a drive section that winds the cleaning member. The operating section accepts a setting for printing without margin by which an image is formed with the toner image being transferred onto the paper sheet as far as at least one edge portion thereof in a width direction perpendicular to a conveyance direction. In the case where the operating section accepts the setting for printing without margin, the control section controls the drive section in such a manner as to increase a winding quantity of the cleaning member per unit time, as compared with the case where the operating section does not accept the setting for printing without margin.

In this configuration, when the operating section accepts the setting for printing without margin, because the toner image is transferred onto the paper sheet as far as at least the one edge portion thereof in the width direction perpendicular to the conveyance direction, the toner is more likely to be scattered from the paper sheet than when the setting for printing without margin is not accepted. The scattered toner sometimes sticks to the fixing rotational member of the fuser unit.

In the case where the operating section accepts the setting for printing without margin, the control section causes the winding quantity of the cleaning member per unit time that is in contact with the surface of the fixing rotational member and thereby cleans the surface of the fixing rotational member to be increased as compared with the case where the operating section does not accept the setting for printing without margin. This enables, in the case where the setting for printing without margin is made, the cleaning member to be wound before the cleaning member becomes unable to remove the toner from the surface of the fixing rotational member. Then, in the case where the setting for printing without margin is not made, the control section causes the cleaning member that is not dirty not to be wound because the cleaning member can remove the toner from the surface of the fixing rotational member.

Moreover, in the case where the operating section accepts the setting for printing without margin, the control section controls the drive section in such a manner as to increase the winding quantity of the cleaning member per unit time as a size of the paper sheet becomes larger.

In the case where the setting for printing without margin is made, since the amount of the toner transferred to the outside of the paper sheet becomes more as the size of the paper sheet becomes larger, the amount of the toner scattered within the interior of the image forming apparatus becomes more; accordingly, the amount of the toner sticking to the adsorption member (fixing rotational member, pressing rotational member) increases. The control section, by controlling the drive section in such a manner as to increase the winding quantity of the cleaning member per unit time, can more surely remove the toner from the surface of the adsorption member.

DETAILED DESCRIPTION OF THE INVENTION

Figure 1:
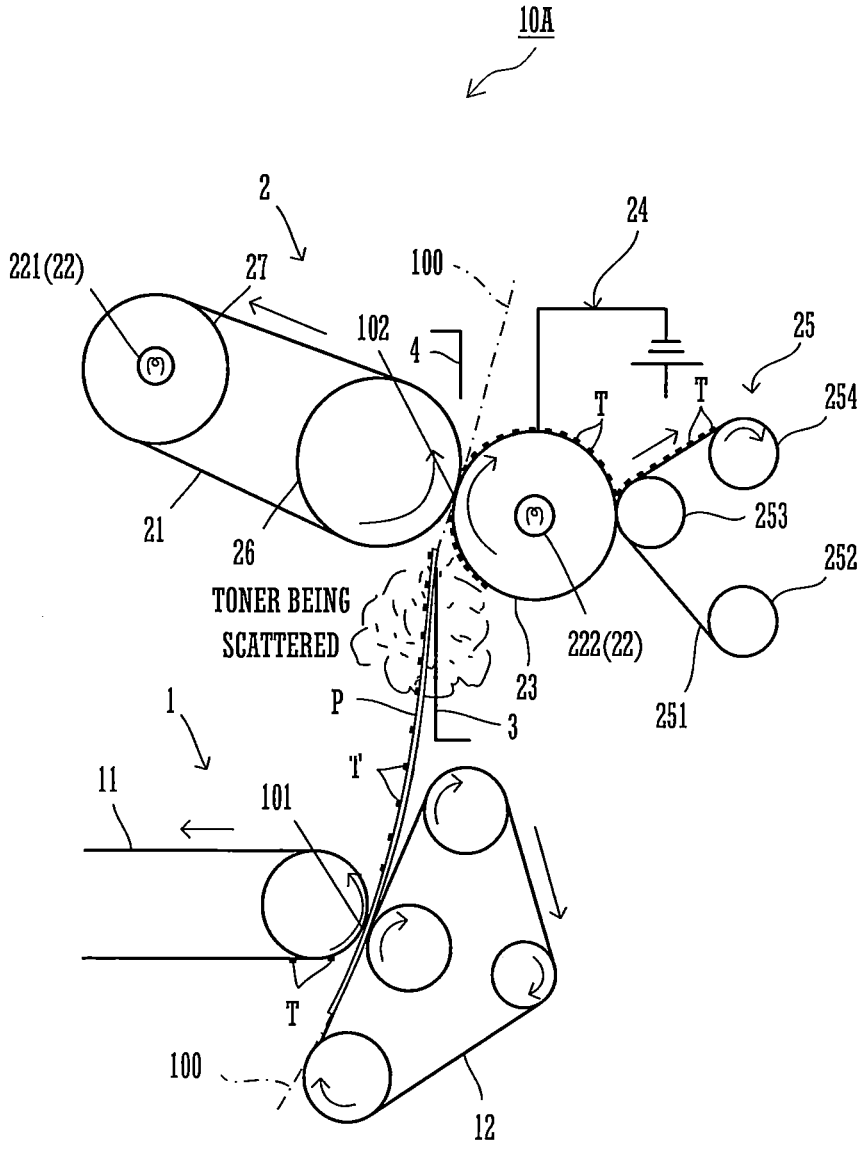
FIG. 1 is a drawing showing a general configuration of an image forming apparatus (essential part) of the present invention.

Embodiments of the present invention are explained below, referring to the drawings. An essential part of an image forming apparatus 10A according to a first embodiment of the present invention is shown in FIG. 1. Since other configurations that constitute the image forming apparatus 10A but are not shown in the above drawing are of those widely known, their illustrations and explanations are omitted. The image forming apparatus 10A of the present invention is an image forming apparatus adapted for printing without margin that forms an image by transferring a toner image onto an imaging area and a margin of a paper sheet. In the printing without margin, an image is formed by forming a toner image beyond a width of a paper sheet P and transferring the toner image onto the paper sheet P as far as an edge portion thereof.

As shown in FIG. 1, the image forming apparatus 10A includes a transfer station 101 and a fuser section 102 that are formed along a paper sheet conveying path 100 where the paper sheet P is conveyed.

At the transfer section 101, the toner image is transferred onto the paper sheet P by a transfer device 1. In the printing without margin, a toner image is formed beyond the width of the paper sheet P, and the toner image is transferred onto the paper sheet P as far as at least one edge portion thereof by the transfer device 1. Therefore, the toner that has not been transferred onto the paper sheet P is scattered. In the drawing above, the Sign T shows the toner (powder) that forms a toner image.

Type of the transfer device is not a question. In this embodiment, a toner image that has undergone a primary transfer onto an intermediate transfer belt 11 that is circularly driven is transferred onto one side of the paper sheet P by a secondary transfer belt 12 that is circularly driven. Since configurations and operations of such a transfer device 1 are widely known, their detailed explanations are omitted.

At the transfer section 101, two belts 11, 12 of the transfer device 1 are in contact with each other with pressure (nipped) through the two rollers facing each other; and the paper sheet P passing through the transfer section 101 is conveyed in the paper sheet conveying path 100 by the circular motions of the two belts 11, 12, and reaches the fuser section 102.

At the fuser section 102, the toner image on the paper sheet P that has not undergone fixing yet is fixed by a fuser unit 2. In the paper sheet conveying path 100 between the transfer section 101 and the fuser section 102, a pre-fusing paper sheet guide 3 is installed. In the paper sheet conveying path 100 on the downstream side from the fuser section 102, a post-fusing paper sheet guide 4 is installed. The pre-fusing paper sheet guide 3 is an example of the paper sheet guide of the present invention.

In this embodiment, the fuser unit 2 includes an endless belt 21, a heat source 22, a pressing roller 23, a grounding structure 24 and a cleaning mechanism 25.

The endless belt 21 is passed over a drive roller 26 and an idle roller 27. The drive roller 26 is rotationally driven by a driving source not shown, and thereby the endless belt 21 is circularly (rotationally) driven. The endless belt 21 is an example of the fixing rotational member of the present invention. For example, the fixing rotational member may even be a roller.

The pressing roller 23 is in contact with the endless belt 21 with pressure at the fuser section 102. The pressing roller 23 is rotatably supported in a state of being urged by an urging device not shown in a direction of a vector from a center of rotation of the pressing roller 23 toward the fuser section 102. Although the urging device itself does not have a driving source, the pressing roller 23 rotates in compliance with the circular motion of the endless belt 21 through a nip pressure with which the pressing roller 23 is in contact with the endless belt 21.

The pressing roller 23 is an example of the pressing rotational member and the adsorption member of the present invention. For the pressing roller 23, a hollow cylinder made of a conductor of electricity such as metal is suitably used. Alternatively, it is also possible to employ a structure in which the hollow cylinder is used as a core and on its circumferential surface an outer layer made of a resin having heat resistant and electrically conductive property is formed. In any event, a surface of the pressing roller 23 is to of electrical conductivity.

The heat source 22 heats the endless belt 21. In this embodiment, the heat source 22 consists of a main heater 221 and an assistant heater 222. The main heater 221 is built inside the idle roller 27 over which the endless belt 21 is passed, and the assistant heater 222 is built inside the pressing roller 23.

The grounding structure 24 grounds the surface of the pressing roller 23. By the surface of the pressing roller 23 that is always grounded through the grounding structure 24, scattered toner T is adsorbed electrostatically due to an electric potential difference formed between the scattered toner T that is electrically charged and the surface of the pressing roller 23. For the grounding structure 24, a diselectrifying brush that rotates being in contact with the surface of the pressing roller 23 can suitably be used. The grounding structure is an example of the electric potential difference forming means of the present invention. For example, the electric potential difference forming means may even be an electrifying structure actively charging the surface of the pressing roller 23.

The cleaning mechanism 25 cleans the surface of the pressing roller 23. The cleaning mechanism 25 is an example of the cleaning means of the present invention. In this embodiment, a web cleaning device circularly driving a web 251 that is in contact with the surface of the pressing roller 23 is illustrated as an example.

The web cleaning device includes the web 251, a send-out roller 252, an abutting roller 253 and a take-up roller 254. The web 251 is an example of the cleaning member of the present invention, and a belt-shaped nonwoven fabric, for example.

The send-out roller 252 sends out a virgin web 251. The abutting roller 253 causes the web 251 that is sent out from the send-out roller 252 to be brought into contact with the surface of the pressing roller 23. The take-up roller 254 is an example of the drive section of the present invention, and winds the web 251 used. The web 251 is configured in such a manner that a surface thereof being in contact with the surface of the pressing roller 23 is moved gradually from the send-out roller 252 toward the take-up roller 254. With this configuration, always clean surface of the web 251 can be brought into contact with the surface of the pressing roller 23, and thereby stains can be wiped off the surface of the pressing roller 23 efficiently. The surface of the pressing roller 23 is cleaned each time by the cleaning mechanism 25. Therefore, the pressing roller 23 serving also as an adsorption member for the scattered toner T can be recycled and used repeatedly.

Moreover, the web 251 is configured in such a manner that a dimension in a lateral direction thereof is larger than a maximum width of the paper sheet usable in printing. In concrete terms, for example, the dimension in the lateral direction of the web 251 is formed greater, by 3 cm on each side as a margin, than the dimension of the maximum width of the paper sheet usable in printing. With this configuration, in the case of printing without margin, even when the scattered toner T sticks to outside of the maximum width of the paper sheet usable in printing on the surface of the pressing roller 23, stains can be wiped off the surface of the pressing roller 23.

Figure 2:
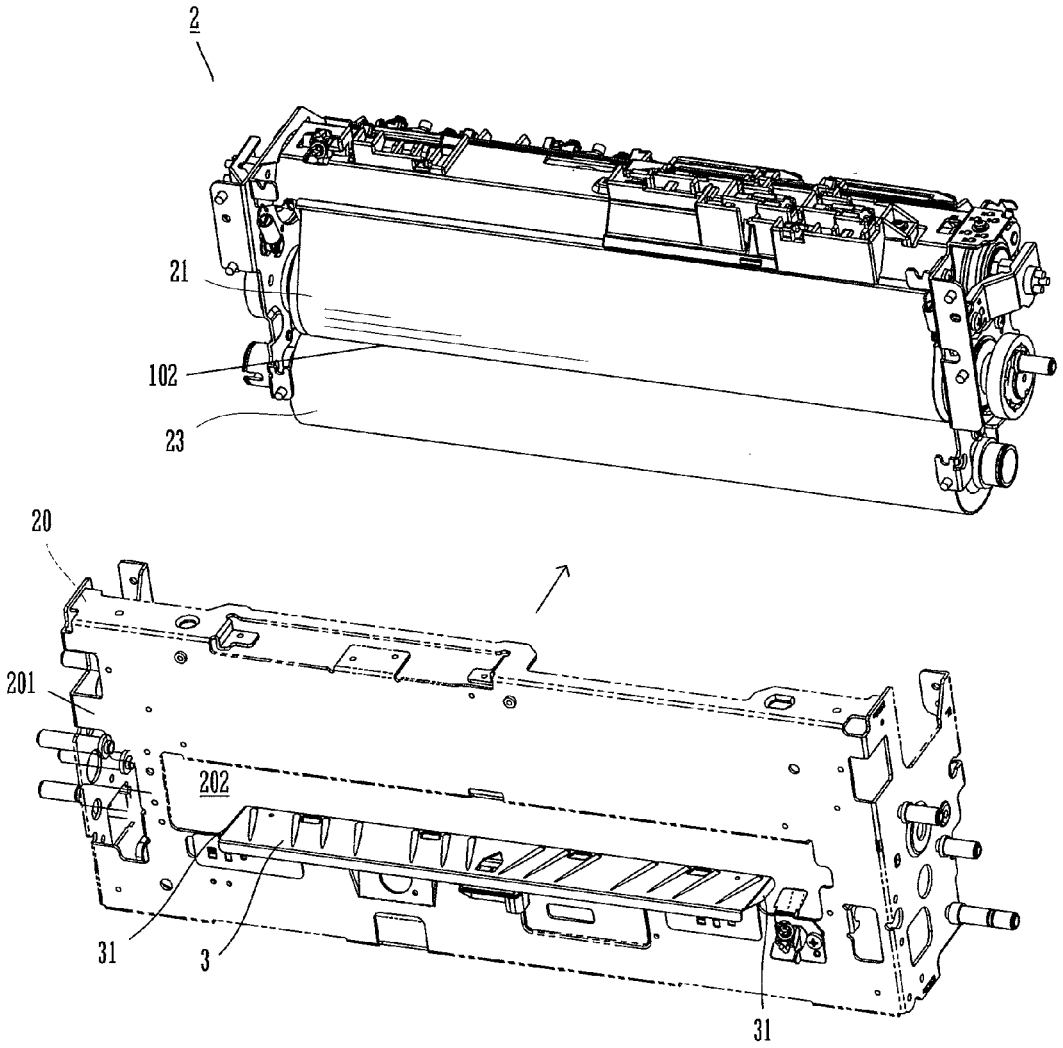
FIG. 2 is a perspective view of a fuser unit, separately showing a housing and a pre-fusing paper sheet guide.

As shown in FIG. 2, the above explained respective elements of the fuser unit 2 are configured inside a durable frame 20 as supporting member. The frame 20 also serves as a pre-fusing cover of the fuser unit 2. A pre-fusing cover section 201 of the frame 20 has an opening 202 facing the fuser section 102.

Figure 3:
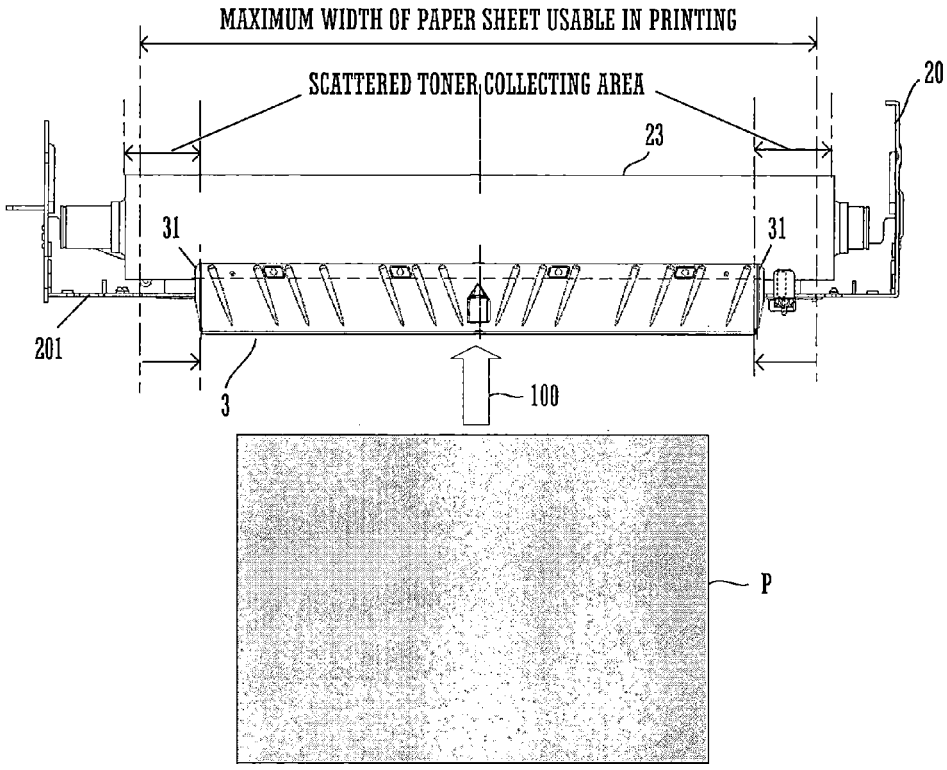
FIG. 3 is a plan view of a pressing roller and the pre-fusing paper sheet guide with respect to a plane parallel to a conveyance direction.
Figure 4:
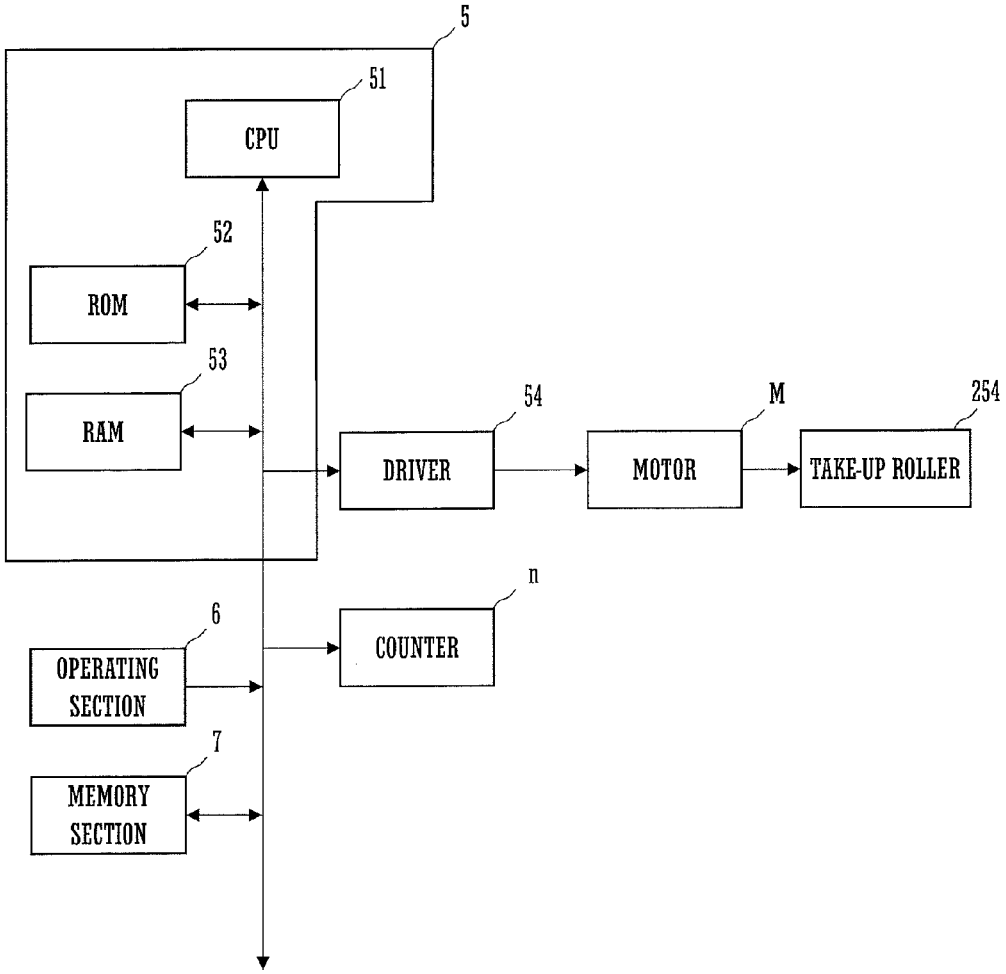
FIG. 4 is a block diagram of a control section of the image forming apparatus.

The pre-fusing paper sheet guide 3 is formed machining a metallic material such as stainless steel (SUS) or the like. The pre-fusing paper sheet guide 3 is installed extending over outside and inside of the pre-fusing cover section 201 through the opening 202 of the pre-fusing cover section 201. Here, as shown in FIG. 3, a downstream edge of the pre-fusing paper sheet guide 3 overlaps the pressing roller 23. At either end of the downstream edge portion of the pre-fusing paper sheet guide 3 which is the overlapping portion, a projection 31 protruding towards the pressing roller 23 with a downward inclination is formed. The projections 31, being inclined toward the pressing roller 23 at the edge portion of the pre-fusing paper sheet guide 3, actively lead the scattered toner T to end portions of the pressing roller 23. In this manner, the scattered toner T is surely led to the end portions on the surface of the pressing roller 23, and thus surely collected by the cleaning mechanism 25.

The pre-fusing paper sheet guide 3, as shown in FIG. 3, is set to a width that is shorter than the maximum width of the paper sheet usable in printing. When the paper sheet P onto which the toner image has been transferred as far as at least one edge portion thereof at the transfer section 101 is conveyed on the pre-fusing paper sheet guide 3, the toner is scattered due to impulse, vibration and/or the like. In particular, the paper sheet P onto which the toner image has been transferred as far as at least one edge portion thereof in the width direction perpendicular to the conveyance direction of the paper sheet is likely to scatter the toner due to impulse, vibration and/or the like. Since the width of the pre-fusing paper sheet guide 3 is set to be shorter than the maximum width of the paper sheet usable in printing, it is suppressed that the toner scattered from the paper sheet P sticks to the edge portion of the pre-fusing paper sheet guide 3. Also, even when the downstream edge of the pre-fusing paper sheet guide 3 overlaps the pressing roller 23 as described above, both end portions on the surface of the pressing roller 23 are to be exposed to space in the paper sheet conveying path 100 without being covered by the pre-fusing paper sheet guide 3.

The control section 5 of the image forming apparatus 10A includes CPU51, ROM52 and RAM53, and is connected to the operating section 6, a memory section 7, a counter n and a driver 54.

The CPU51 reads out a control program stored in the ROM52, and carries out the control program, utilizing the RAM53 as a working area.

The operating section 6 accepts various kinds of settings in an image forming process, and an order to start the image forming process and so forth. The various kinds of settings in the image forming process includes a setting for printing, without margin that effects a function of printing without margin.

The memory section 7 stores a winding quantity x, a coefficient alpha ($\alpha$) and a predetermined value N. The winding quantity x is a quantity on winding at which the web 251 is wound per a predetermined number of sheets that undergo the image forming process when the setting for printing without margin is not made, and is set to 0.7 mm. The coefficient alpha ($\alpha$) is a magnification factor to be applied, when the setting for printing without margin is made, to the winding quantity x for when the setting for printing without margin is not made, and is set to 3. The predetermined value N is a value that specifies a number of sheets to undergo the image forming process as a timing to start winding the web 251, and is set to 18.

The counter n counts a number of sheets that have undergone the image forming process.

The control section 5 outputs a drive data to the driver 54 with the predetermined timing to start winding the web 251. The driver 54, based on the drive data, selectively supplies a power to a motor M that is rotatably poised. The motor M is connected to the take-up roller 254.

Figure 5:
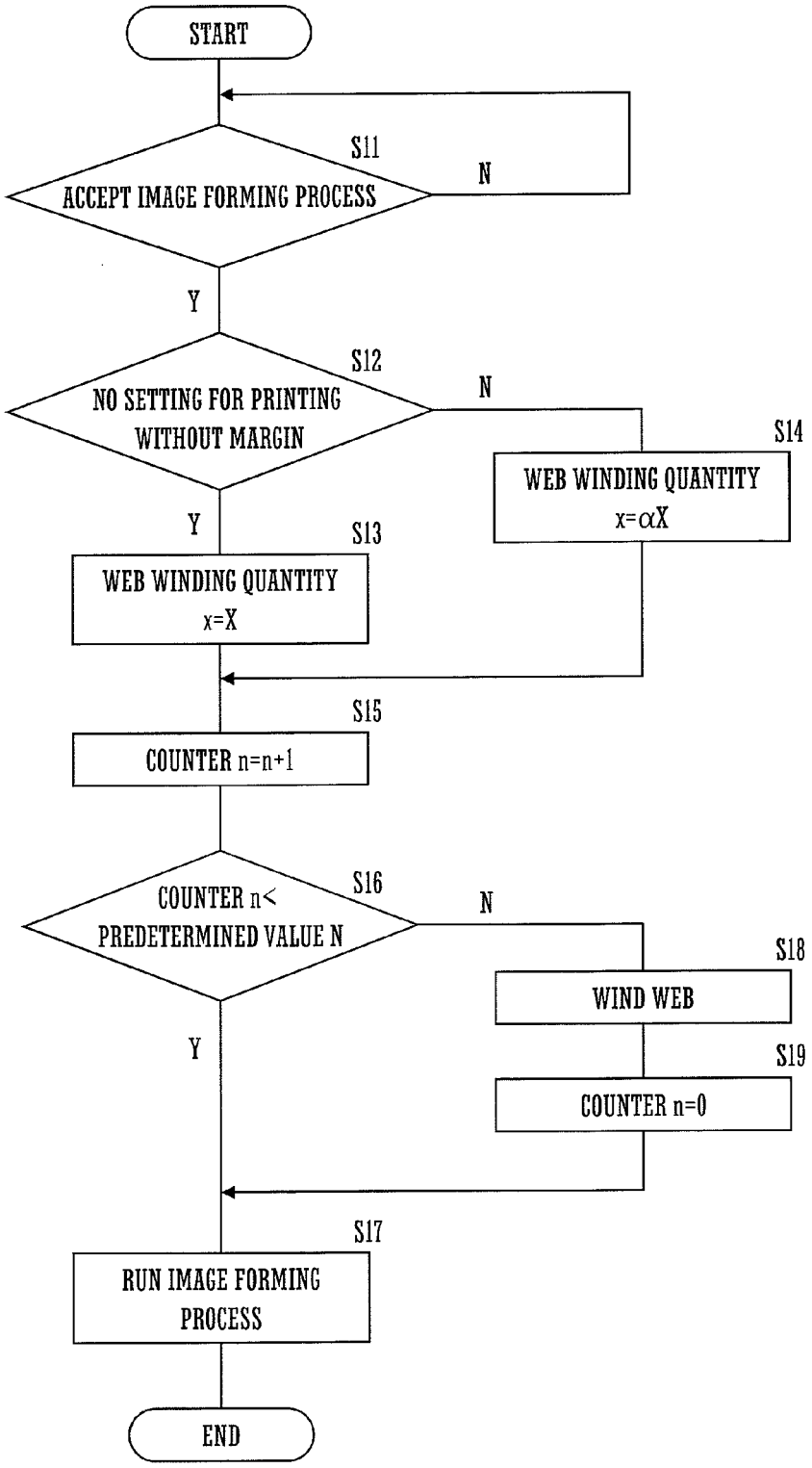
FIG. 5 is a flow chart relating to an image forming process by the control section.

Also, if the operating section 6 accepts an order to start an image forming process, the control section 5 carries out the image forming process. As shown in FIG. 5, the control section 5 waits until an order to start the image forming process is inputted from the operating section 6 (S11). When the order to start the image forming process is inputted, the control section 5 judges whether the setting for printing without margin is made (S12). When the setting for printing without margin is not made, the control section 5, referring to contents stored in the memory section 7, sets the winding quantity x of the web 251 to X (=0.7 mm) (S13), and increases the counter n that indicates the number of sheets that have undergone the image forming process by 1 (S15). The control section 5 judges whether or not the counter n indicates a value less than a predetermined value N (=18) (S16). If the counter n indicates a value less than the predetermined value N, the control section 5 carries out the image forming process (S17).

Also, when the counter n indicates a value not less than the predetermined value N, the control section 5 causes the take-up roller 254 to wind the web 251 by only the winding quantity x of the web 251 (S18), resets the value of the counter n (S19), and then carries out the image forming process (S17).

Further, in the case where the setting for printing without margin is made in the process of S12, the control section 5, referring to the contents stored in the memory section 7, sets the winding quantity x of the web 251 to X (=3×0.7=2.1 mm) (S14), and proceeds to a process of S15.

In this manner, because the toner is scattered in the case where the setting for printing without margin is made, the control section 5 sets the winding quantity of the web 251 per unit time to a value three times larger as compared with the case where the setting for printing without margin is not made. This makes it possible to wind the web 251 before the web 251 becomes unable to remove the toner from the surface of the pressing roller 23 and thus to surely remove the toner from the surface of the pressing roller 23 in the case where the setting for printing without margin is made, and also makes it possible to remove the toner from the surface of the pressing roller 23 and not to wind the web 251 that is not dirty in the case where the setting for printing without margin is not made. As a result, not only can wasteful consumption of the web 251 be prevented, but also the scattered toner can be surely collected.

Additionally, in the above-mentioned embodiment, if the number of sheets accumulated through the image forming process becomes not less than 18, the control section 5 causes the web 251 to be wound by 2.1 mm in the case where the setting for printing without margin is made, and causes the web 251 to be wound by 0.7 mm in the case where the setting for printing without margin is not made. However, what is necessary is that when the setting for printing without margin is made the winding quantity of the web 251 per unit time should be three times larger than when the setting for printing without margin is not made. For example, it is acceptable that the control section 5 causes the web 251 to be wound by 0.7 mm if the number of sheets accumulated through the image forming process becomes not less than 18 in the case where the setting for printing without margin is not made and then causes the web 251 to be wound by 0.7 mm if the number of sheets accumulated through the image forming process becomes not less than 6 in the case where the setting for printing without margin is made.

Further, instead of the pressing roller 23, the fuser unit 2 may be provided with a belt that is passed over a plurality of rollers, in which the belt is in contact with the endless belt 21 with pressure.

An image forming apparatus according to a second embodiment differs from the image forming apparatus according to the first embodiment in that in the case where the setting for printing without margin is made the former changes a winding quantity of the web 251 per unit time depending on sizes of the paper sheet P. The control section 5 causes the winding quantity of the web 251 per unit time to increase as the size of the paper sheet P becomes larger; because the larger the size of the paper sheet P, the more the amount of the toner scattered.

For example, if the setting for printing without margin is not made, the coefficient alpha ($\alpha$) is set to 1 regardless of size of the paper sheet P. And in the case where the setting for printing without margin is made, the winding quantity x of the web 251 per once is changed depending on the sizes of the paper sheet P by setting the coefficient alpha ($\alpha$) to 3 when the paper sheet P is of A4 size, and setting the coefficient alpha ($\alpha$) to 2 when the paper sheet P is of B5 size. As the size of the paper sheet P becomes larger, it is necessary that the value of the coefficient alpha ($\alpha$) should be set in such a manner that the winding quantity x of the web 251 per once increases.

Moreover, for example, in the case where the setting for printing without margin is not made, the web 251 is wound by 0.7 mm if the number of sheets accumulated through the image forming process becomes not less than 18 regardless of the size of the paper sheet P. Then, in the case where the setting for printing without margin is made, with a constant winding quantity x of the web 251 per once, the timing to start winding the web 251 is changed depending on the sizes of the paper sheet P by winding the web 251 by 0.7 mm if the number of sheets accumulated through the image forming process becomes not less than 6 when the paper sheet. P is of A4 size, and by winding the web 251 by 0.7 mm if the number of sheets accumulated through the image forming process becomes not less than 9 when the paper sheet P is of B5 size. As the size of the paper sheet P becomes larger, it is necessary that the timing to start winding of the web 251 should be quicker.

An image forming apparatus 10B according to a third embodiment cleans the surface of the endless belt 21 by the cleaning mechanism 25.

Figure 6:
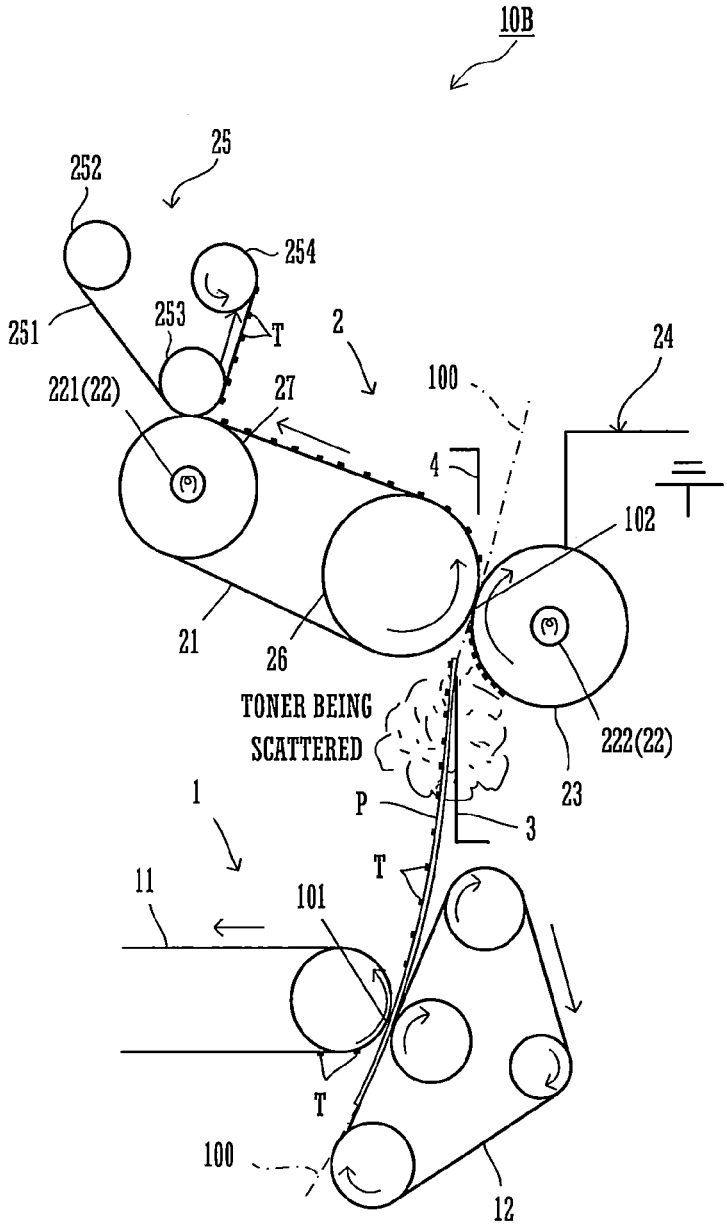
FIG. 6 is a drawing showing a general configuration of an image forming apparatus (essential part) according to another embodiment of the present invention.

As shown in FIG. 6, the abutting roller 253 causes the web 251 that is sent out from the send-out roller 252 to be brought into contact with the surface of the endless belt 21. The web 251 is configured in such a manner that a surface thereof in contact with the surface of the endless belt 21 is moved gradually from the send-out roller 252 toward the take-up roller 254. The endless belt 21 is an example of the adsorption member of the present invention.

Also, as shown in FIG. 5, when the operating section 6 accepts the order to start the image forming process, because the toner is scattered in the case where the setting for printing without margin is made, the control section 5 sets the winding quantity of the web 251 per unit time to a value three times larger as compared with the case where the setting for printing without margin is not made. This makes it possible to wind the web 251 before the web 251 becomes unable to remove the toner from the surface of the endless belt 21 and thereby to surely remove the toner from the surface of the endless belt 21 in the case where the setting for printing without margin is made. Also, this makes it possible to remove the toner from the surface of the endless belt 21 and not to wind the web 251 that is not dirty in the case where the setting for printing without margin is not made. As a result, the image forming apparatus 10B is capable of not only preventing wasteful consumption of the web 251, but also surely collecting the scattered toner.

An image forming apparatus 100 according to a fourth embodiment includes a cleaning mechanism 28 that cleans the surface of the endless belt 21.

Figure 7:
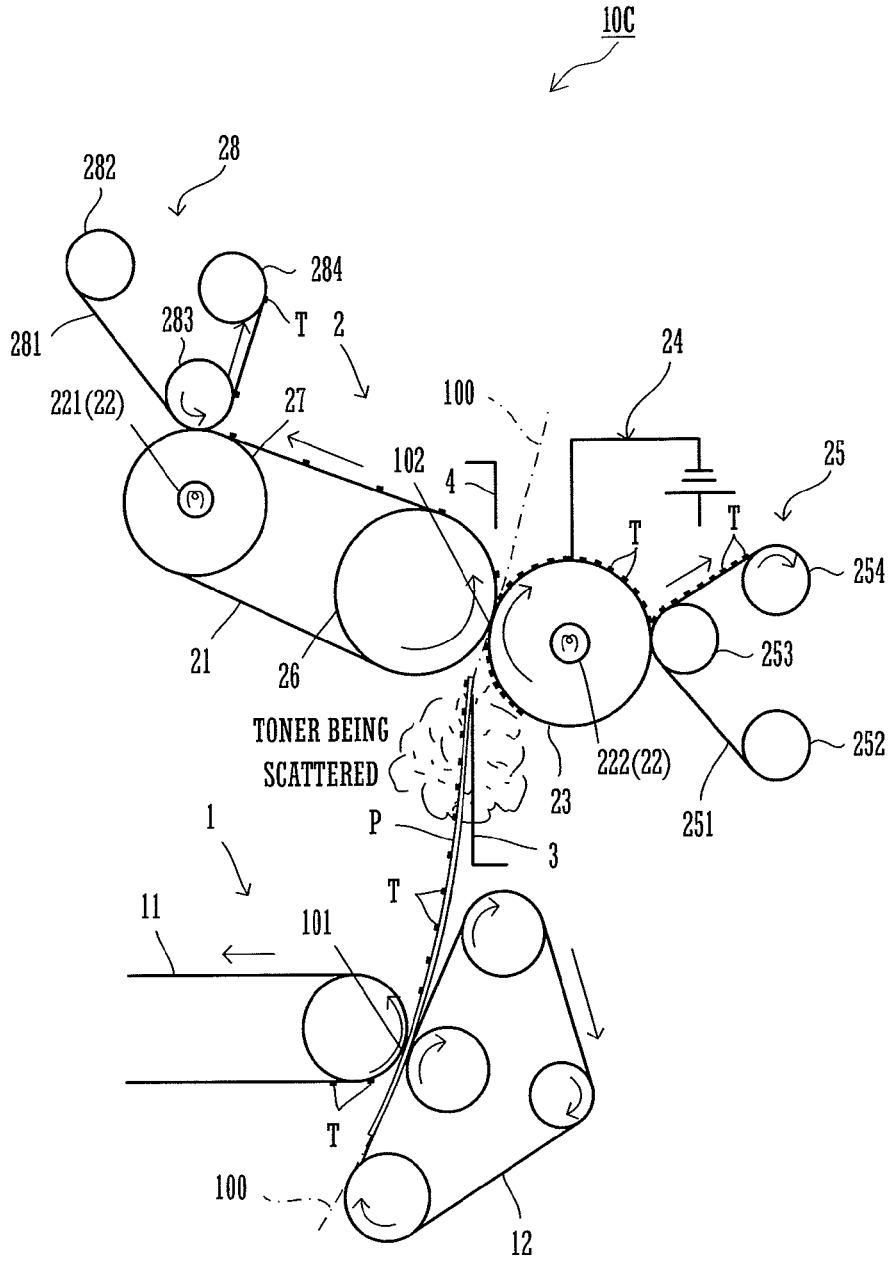
FIG. 7 is a drawing showing a general configuration of an image forming apparatus (essential part) according to still another embodiment of the present invention.

As shown in FIG. 7, the cleaning mechanism 28 has the same structure as the cleaning mechanism 25, and cleans the surface of the endless belt 21. This ensures that the scattered toner T that sticks to the endless belt 21 without being electrostatically adsorbed by the pressing roller 23 can also be collected surely. The web 251 and the web 281 are examples of a first cleaning member and a second cleaning member of the present invention, respectively.

Moreover, in the image forming process, in the case where the setting for printing without margin is not made in the process of S12, as shown in FIG. 5, the control section 5, referring to the contents stored in the memory section 7, set a winding quantity x of the webs 251, 281 to X (=0.7 mm) (S13). Also, in the case where the setting for printing without margin is made in the process of S12, the control section 5, referring to the contents stored in the memory section 7, set the winding quantity x of the webs 251, 281 to alpha ($\alpha$)*X (=3×0.7=2.1 mm) (S14).

In this manner, because the toner is scattered in the case where the setting for printing without margin is made, the control section 5 sets the winding quantity of the webs 251, 281 per unit time to a value three times larger as compared with the case where the setting for printing without margin is not made. This makes it possible to wind the webs 251, 281 before the webs 251, 281 become unable to remove the toner from the surfaces of the pressing roller 23 and the endless belt 21 and thereby to surely remove the toner from the surfaces of the pressing roller 23 and the endless belt 21 in the case where the setting for printing without margin is made. This also makes it possible to remove the toner from the surfaces of the pressing roller 23 and the endless belt 21 and not to wind the webs 251, 281 that are not dirty in the case where the setting for printing without margin is not made. As a result, the image forming apparatus 10C is capable of not only preventing wasteful consumption of the webs 251, 281 but also surely collecting the scattered toner.

Additionally, because the amount of the scattered toner T sticking to the endless belt 21 is smaller than the amount of the scattered toner T adsorbed by the pressing roller 23, the winding quantity x of the web 281 per unit time may be reduced as compared with the winding quantity x of the web 251 per unit time. With this configuration, wasteful consumption of the web 281 can be prevented further as compared with making the winding quantities of the webs 251, 281 per unit time the same.

Moreover, although it has been stated above that the control section 5 sets the winding quantities x of the webs 251, 281 per unit time to a value three times larger in the case where the setting for printing without margin is made as compared with the case where the setting for printing without margin is not made, it may be acceptable that only the winding quantity x of the web 251 per unit time is multiplied by 3 because the amount of the scattered toner T sticking to the endless belt 21 is smaller than the amount of the scattered toner T adsorbed by the pressing roller 23. With this configuration, wasteful consumption of the web 281 can be prevented further as compared with having both of the winding quantities of the webs 251, 281 per unit time multiplied by 3.

The above explanations of the embodiments are nothing more than illustrative in any respect, nor should be thought of as restrictive. Scope of the present invention is indicated by claims rather than the above embodiments. Further, it is intended that all changes that are equivalent to a claim in the sense and realm of the doctrine of equivalence be included within the scope of the present invention.

What is claimed is:

1. An image forming apparatus comprising:

a paper sheet guide on which a paper sheet a toner image has been transferred onto is conveyed;

an adsorption member that is disposed in the neighborhood of the paper sheet guide and adsorbs toner scattered from the paper sheet conveyed on the paper sheet guide;

a cleaning means including a belt-shaped cleaning member that is in contact with a surface of the adsorption member and thereby cleans the surface of the adsorption member, and a drive section that winds the cleaning member;

an operating section accepting a setting for printing without margin by which an image is formed with the toner image being transferred onto the paper sheet as far as at least one edge portion thereof; and a control section that controls the drive section in such a manner as to increase a winding quantity of the cleaning member per unit time in a case where the operating section accepts the setting for printing without margin, as compared with a case where the operating section does not accept the setting for printing without margin.

2. The image forming apparatus as claimed in claim 1, wherein the adsorption member has electrical conductivity on the surface thereof, the adsorption member further including an electric potential difference forming means that forms an electric potential difference between an electric potential of the surface of the adsorption member and an electric potential of the toner.

3. The image forming apparatus as claimed in claim 1, wherein a fuser unit fixing the toner image on the paper sheet is disposed downstream from the paper sheet guide, the fuser unit including a fixing rotational member, a heat source heating the fixing rotational member, and a pressing rotational member that is caused to be in contacted with the fixing rotational member with pressure; and either the fixing rotational member or the pressing rotational member also serves as the adsorption member.

4. The image forming apparatus as claimed in claim 3, wherein the cleaning member includes at least either a first cleaning member that is in contact with a surface of the fixing rotational member and thereby cleans the surface of the fixing rotational member or a second cleaning member that is in contact with a surface of the pressing rotational member and thereby cleans the surface of the pressing rotational member; and the control section controls the drive section in such a manner as to increase a winding quantity of at least either the first cleaning member or the second cleaning member per unit time in the case where the operating section accepts the setting for printing without margin, as compared with the case where the operating section does not accept the setting for printing without margin.

5. The image forming apparatus as claimed in claim 1, wherein the control section controls the drive section in such a manner as to increase the winding quantity of the cleaning member per unit time as a size of the paper sheet becomes larger.

6. An image forming apparatus comprising:

a fuser unit fixing a toner image on a paper sheet, the fuser unit including a fixing rotational member, a heat source heating the fixing rotational member, and a pressing rotational member that is caused to be in contacted with the fixing rotational member with pressure;

a cleaning means including a belt-shaped cleaning member that is in contact with a surface of the pressing rotational member and thereby cleans the surface of the pressing rotational member, and a drive section that winds the cleaning member;

an operating section accepting a setting for printing without margin by which an image is formed with the toner image being transferred onto the paper sheet as far as at least one edge portion thereof in a width direction perpendicular to a conveyance direction; and a control section that controls the drive section in such a manner as to increase a winding quantity of the cleaning member per unit time in a case where the operating section accepts the setting for printing without margin, as compared with a case where the operating section does not accept the setting for printing without margin.

7. The image forming apparatus as claimed in claim 6, wherein the control section controls the drive section in such a manner as to increase the winding quantity of the cleaning member per unit time as a size of the paper sheet becomes larger.

8. An image forming apparatus comprising:

a fuser unit fixing a toner image on a paper sheet, the fuser unit including a fixing rotational member, a heat source heating the fixing rotational member, and a pressing rotational member that is caused to be in contact with the fixing rotational member with pressure;

a cleaning means cleaning a surface of either the fixing rotational member or the pressing rotational member;

an operating section accepting a setting for printing without margin by which an image is formed with the toner image being transferred onto the paper sheet as far as at least one edge portion thereof in a width direction perpendicular to a conveyance direction; and a control section that controls the cleaning means in such a manner as to increase a cleaning quantity by the cleaning means in a case where the operating section accepts the setting for printing without margin, as compared with a case where the operating section does not accept the setting for printing without margin.

9. The image forming apparatus as claimed in claim 8, wherein the cleaning means includes a belt-shaped cleaning member that is in contact with the surface and thereby cleans the surface, and a drive section that winds the cleaning member; and the control section controls the drive section in such a manner as to increase a winding quantity of the cleaning member per unit time as a size of the paper sheet becomes larger.

10. An image forming method comprising:

a fixing step fixing a toner image on a paper sheet on the paper sheet by causing a pressing rotational member to be in contact with pressure with a fixing rotational member that is heated by a heat source and causing the paper sheet to pass between these members; and a cleaning step cleaning a surface of either the fixing rotational member or the pressing rotational member after the fixing step, wherein the cleaning step increases, through a control section, a cleaning quantity in a case where a setting for printing without margin by which an image is formed with the toner image being transferred onto the paper sheet as far as at least one edge portion thereof in a width direction perpendicular to a conveyance direction is accepted, as compared with a case where the setting for printing without margin is not accepted.

* * * * *